US008920607B2

(12) United States Patent
Kim

(10) Patent No.: US 8,920,607 B2
(45) Date of Patent: Dec. 30, 2014

(54) METHOD FOR PRODUCING INDIVIDUAL COMPACTS SUITABLE FOR COKE OVEN CHAMBERS BY DIVIDING A COAL CAKE IN A NON-MECHANICAL MANNER

(75) Inventor: Ronald Kim, Essen (DE)

(73) Assignee: ThyssenKrupp UHDE GmbH, Dortmund (DE)

( * ) Notice: Subject to any disclaimer, the term of this patent is extended or adjusted under 35 U.S.C. 154(b) by 368 days.

(21) Appl. No.: 13/574,744

(22) PCT Filed: Dec. 14, 2010

(86) PCT No.: PCT/EP2010/007589
§ 371 (c)(1),
(2), (4) Date: Jul. 23, 2012

(87) PCT Pub. No.: WO2011/088873
PCT Pub. Date: Jul. 28, 2011

(65) Prior Publication Data

US 2012/0297670 A1 Nov. 29, 2012

(30) Foreign Application Priority Data

Jan. 21, 2010 (DE) ..... 10 2010 005 353

(51) Int. Cl.
*C10B 53/00* (2006.01)
*C10B 45/02* (2006.01)
*C10B 31/08* (2006.01)
*C10B 57/08* (2006.01)

(52) U.S. Cl.
CPC ..... *C10B 45/02* (2013.01); *C10B 31/08* (2013.01); *C10B 57/08* (2013.01)
USPC ..... 201/6; 201/8; 201/24; 201/40; 201/41; 264/120; 264/148; 44/591; 44/596; 44/620; 44/626

(58) Field of Classification Search
CPC ..... C10B 45/02; C10B 31/08; C10B 57/08; C10B 53/08; C10L 5/06
USPC ..... 201/6, 8, 24, 40, 41; 264/120, 148; 44/591, 596, 620, 626
See application file for complete search history.

(56) References Cited

U.S. PATENT DOCUMENTS

| | | | | |
|---|---|---|---|---|
| 4,318,779 | A * | 3/1982 | Tsuyuguchi et al. | 201/6 |
| 4,385,962 | A * | 5/1983 | Stewen et al. | 201/6 |
| 4,606,876 | A * | 8/1986 | Yoshida et al. | 264/120 |
| 6,046,427 | A | 4/2000 | Richter et al. | |
| 6,059,932 | A * | 5/2000 | Sturgulewski | 202/262 |
| 7,497,930 | B2 * | 3/2009 | Barkdoll et al. | 201/41 |
| 7,815,829 | B2 * | 10/2010 | Schuecker | 264/148 |
| 8,105,516 | B2 * | 1/2012 | Fiedler et al. | 264/120 |
| 2006/0070419 | A1 * | 4/2006 | Johnson et al. | 72/262 |
| 2007/0289861 | A1 * | 12/2007 | Barkdoll et al. | 201/8 |
| 2008/0032610 | A1 | 2/2008 | Chacko et al. | |
| 2008/0087538 | A1 * | 4/2008 | Schuecker | 201/6 |
| 2009/0321980 | A1 * | 12/2009 | Fiedler et al. | 264/120 |
| 2012/0055353 | A1 | 3/2012 | Kim | |

FOREIGN PATENT DOCUMENTS

| | | |
|---|---|---|
| DE | 4430133 | 2/1996 |
| DE | 19537467 | 2/1997 |
| DE | 19545736 | 6/1997 |
| DE | 102009011927 | 9/2010 |
| EP | 2123402 | 11/2009 |
| GB | 190408559 | 12/1904 |
| JP | 59122581 | 7/1984 |

OTHER PUBLICATIONS

International Search Report for PCT/EP2010/007589, Completed by the European Patent Office on Mar. 16, 2011, 7 Pages.
Rex et al. Website http:www.coke-over-managers.org/PDFs/2006/compact_coal.pdf , "Compancting of coal for heat recovery ovens illawarra coke company PTY LTD coalcliffe, NSW, Australia." 2005, 11 Pages.
Schwarzenbach. European Production Engineering Apr. 1995, vol. 19, No. 1/2, p. S16-S18, "Light and Water. The Sharp Alternatives."

* cited by examiner

*Primary Examiner* — James Goloboy
*Assistant Examiner* — Latosha Hines
(74) *Attorney, Agent, or Firm* — Brooks Kushman P.C.

(57) ABSTRACT

A method for producing individual compacts made of coke and suitable for coke oven chambers by dividing a coal cake in a non-mechanical manner, wherein the coal cake is produced by a compression method according to the prior art and the coal cake is divided by non-mechanical, energy-supplying media, and the non-mechanical media supplying shearing energy are, for example, a laser beam, a high-pressure water jet, an abrasive-solid jet, an ultrasonic beam, a compressed-air jet, or a gas jet. By using the method, coal compacts can be produced from coal cakes without forming dust, without wearing out cutting tools, and with high precision.

14 Claims, No Drawings

METHOD FOR PRODUCING INDIVIDUAL COMPACTS SUITABLE FOR COKE OVEN CHAMBERS BY DIVIDING A COAL CAKE IN A NON-MECHANICAL MANNER

CROSS-REFERENCE TO RELATED APPLICATION

This application is the U.S. national phase of PCT Appln. No. PCT/EP2010/007589 filed on Dec. 14, 2010, which claims priority to DE Patent Application No. 10 2010 005 353.8 filed on Jan. 21, 2010, the disclosures of which are incorporated in their entirety by reference herein.

The invention relates to a method for the production of compacted individual blocks of coke suitable for coke-oven chambers by non-mechanical cutting of a compressed coal cake, in which the compressed coal cake is obtained by compression methods according to the state of the art and cutting of the compressed coal cake is achieved using non-mechanical, energy-providing media. The inventive process serves to produce compacted coal blocks which can be obtained without any additional spacious cutting devices such that it is no longer required to take the compressed coal cake to a different place for cutting it into compacted coal blocks.

Coking-chamber ovens can be loaded in many different ways. There are some types of coke-oven chambers that are loaded through the roof which is of advantage for the design of the pusher machines. Loading of such oven types is performed through loading ports in the coke-oven roof by special loading machines installed on the coke-oven roof. The weight of the loading machines acting upon the oven roof, however, produces a disproportional mechanical load on the oven walls. This will shorten the service life of the ovens. At the same time, the machines which operate in regular sequences hamper the oven-heating-relevant work procedures at the primary-air metering ports in the oven roof and may therefore constitute a considerable safety risk for the operating personnel working there. In addition, cleaning of the coke-oven roof is a problem not to be neglected.

Most recent-type coke-oven chambers are therefore loaded through coke-oven chamber doors to be opened at the front, making loading significantly quicker, safer and cleaner. For this purpose, doors are provided in front of the ports on both frontal sides of the coke-oven chamber, through which the coke-oven chamber can be loaded and discharged.

Loading machines and pusher machines are typically installed on one side which can be moved in front of the coking-chamber ovens alongside the frontal walls and moved in front of the respective coke-oven chamber for the purpose of loading or unloading. On the other frontal side there is a quenching car which can also be moved in front of the coking-chamber ovens alongside the frontal walls and be loaded with the hot coke after the end of the coking process. This quenching car takes the coke to the quenching tower for quenching.

DE 19545736 A1 describes a well-established embodiment for the loading of horizontal coke-oven chambers. Here, the coal is tipped onto a plane carrier plate outside the oven at an even level and is then compacted; subsequently the homogeneously compacted coal cake on the carrier plate is pushed into the oven chamber, the carrier plate then being pulled out of the oven chamber again while retaining the coal cake at the front end. This method serves in particular to load horizontal coke-oven chambers which are equipped with bottom heating.

In this process, however, the high coal compaction degree of densities of up to 1200 kg/m$^3$ hampers the vertical escape of the raw gases contained, which are generated during the coking process. Thus major part of the raw gases initially remains in the coal cake for an extended period of time and is initially not available for the combustion process. It thus escapes only after an extended period of time through gaps which form at the rims of the coal cake between the oven wall and the coal cake due to coking processes of the coal.

This inhibits the coking process and reduces the economic efficiency, as in this coking process type the process energy required is generated only by the combustion of the raw gases contained in the coal. In order to achieve uniform surface heating in the combustion chamber above the coal, it is necessary to make the raw gases rise into the combustion chamber in vertical direction and uniformly distributed across the surface area. Furthermore, it is impossible to batch the coal in an accurate way by the mentioned process as the coal portions fed to the coke-oven chamber are not necessarily cut to an exact size. This method also involves that during loading small pieces of coal may drop in front of the coke-oven chamber.

For this reason there are processes according to the state of the art which include compacting of the coal into compressed coal blocks or compacted coal blocks which can be fed to the coke oven more easily. The arrangement of these blocks on the carrier plate is implemented in a process-optimised form providing gaps of several centimetres between the compacted blocks. These compacted coal blocks are packed so densely that no or only extremely few pieces of coal can get lost when transporting the coal portions. The compacted coal blocks are produced by compressing the coal with a suitable press machine, yielding first a large coal cake, which is cut into compacted coal blocks of the requested size using suitable cutting tools. The blocks are stacked for coking and pushed into the coke-oven chamber using a charging machine or another suitable device.

An example of the cutting of already prepared compressed coal cakes by means of mechanical tools is described in DE 102009011927.2. Compressing of the coal portions into a compacted coal cake can be done in different ways, the shaping typically being done by a press machine which first forms a large press cake, from which compacted coal blocks can be cut to the requested size by means of suitable cutting tools. The blocks are stacked for coking and pushed into the coke-oven chamber by means of a charging machine or another device. Suitable as cutting tools, for example, are metal blades or saw blades. Other potential cutting tools are wires or metal rods.

Spacers which are made of combustible material, such as residue-free paper, are inserted in the compacted-block structure of the coal cake thus produced and ensure the separation of the individual compacted blocks in the oven. These spacers prevent that the compacted blocks produced are squeezed together horizontally when the carrier plate is pulled out again during the charging operation and burn up already shortly after the loading process due to the high temperatures of more than 1000° C. in the oven chamber. In this way it is possible to generate the necessary gaps from which the raw gases can now rise vertically into the combustion chamber above the coal cake and combust. In this manner it is possible to provide the batch with a surface heating from above even in the case of compacted feed coal, which will result in a high oven output.

These mechanical cutting tools according to the mentioned teaching must be sturdy enough to achieve compacting of the coal cake, as great force is to be exerted for cutting the coal cake. They must also resist the abrasion to which the cutting tools are exposed in the course of time. This applies to an only limited degree, however, especially in the case of wires or rods. Another disadvantage involved in the use of cutting tools is the inaccurate adjustment of the cutting tools. Frequently they produce compacted blocks which are not compacted precisely but can be compacted only to a size of certain tolerances in dimensions due to the bending behaviour of the mechanical cutting tools. The cutting width of compacted coal blocks by means of conventional cutting tools can therefore be adjusted to an insufficient degree only. In this way it is not always possible to dimension the compacted blocks accurately and to have the coking gases degas reliably with a surface heating.

For this reason, it would be of advantage to provide an accurate method for the production of compacted coal blocks in an accurate, quick and effective way. It is aimed to use cutting tools of little abrasion and in addition avoid the development of coal dust. It is further aimed to reach a channel width in the coal cake of the compacted blocks obtained by cutting which is as accurate and defined as possible in order to ensure an exact size of the compacted blocks and degassing to a reliable extent.

Therefore it is the aim to provide a method which serves to produce compacted blocks with utmost accuracy and high reproducibility from a compressed coal cake within a short period of time without any wear of the cutting devices and with low emission development.

The method achieves this aim by providing a method for the production of compacted individual blocks suitable for coke-oven chambers by non-mechanical cutting of a compressed coal cake, this non-mechanical method being understood in particular as a cutting technique applying laser beams, high-pressure water jets or sandblasting.

Especially claimed is a method for the production of compacted individual blocks suitable for coke-oven chambers by non-mechanical cutting of a compressed coal cake in which the coal is compressed and compacted into one or a plurality of coal cake portions by means of a suitable compression device to obtain at least one densely packed and lump-free coal cake suitable for coal compacting, which is characterised in that the coal cake obtained is cut into compacted blocks by non-mechanical, cutting-energy providing media to obtain compacted coal blocks which are to be loaded into a coke-oven chamber to be loaded horizontally either separately or horizontally strung together or stacked on top of each other or horizontally strung together and stacked on top of each other or horizontally strung together and stacked on top of each other.

In one embodiment of the invention the non-mechanical, cutting-energy providing medium is a laser beam. In another embodiment the non-mechanical, cutting-energy providing medium is a high-pressure water jet. In a further embodiment the non-mechanical, cutting-energy providing medium is a high-pressure sandblast.

Laser cutting can be implemented by all laser beam types suited to cut compressed coal cakes. An example of a laser beam type suitable for cutting coal is the $CO_2$ laser. DE 19537467 C1 describes an example of a suitable method of laser-beam cutting.

Cutting by means of water jets can be implemented by all water-jet cutting methods suited for cutting into compressed coal blocks. Examples of suitable water-jet cutting methods are the abrasive water-jet cutting or the pure water-jet cutting. An example of a suitable water-jet cutting method is described in US 2008/0032610 A1. The method is suitable for cutting into compressed coal blocks and allows addition of abrasives into the water jet.

Cutting the coal cake by way of solid abrasive blasting can theoretically be implemented by all methods suitable for cutting coal cakes. Examples of suitable solid abrasive blasting methods are the dry abrasive blasting or the slurry blasting method. GB 190408559 gives an example of a sandblasting method for the removal of coal from rocky coal mines. EP 2123402 A1 gives an example of a dry abrasive blast-cutting method. DE 4430133 A1 gives an example of an abrasive blast-cutting method using slurry blasts.

The non-mechanical, cutting-energy providing media can also be an air-jet or a nitrogen gas jet. The air or gas jet may be heated. And finally ultrasound or other media may also be used as non-mechanical, cutting-energy providing media. Ultrasound can be applied to the coal by means of special tools allowing the cutting by means of ultrasound.

The before-mentioned methods can be used individually but also in combination.

In an embodiment of the invention, gap-retaining spacers of combustible material are inserted between the compacted blocks produced to obtain a gap geometry upon spacer burn-up at high oven temperatures. The spacers burn up without residue during the coking process. The insertion of the spacers subsequent to the cutting of the coal cake by a non-mechanical, cutting-energy providing medium is typically implemented prior to or during the loading operation.

In a typical embodiment the spacers have a thickness of up to 200 mm. They burn up without residue during the coking process. They are made of, for example, paper, cardboard, wood or plastics. The defined gaps thus generated have a width of at least 5 mm in the finished coke cake.

In a typical embodiment the inventive process for the production of compacted individual blocks suitable for coke-oven chambers is operated in such a way that the compacted coal blocks obtained are loaded into a horizontal coke-oven chamber of the "non-recovery" or "heat recovery" type. These utilise the coking gases developed in the coking process for the generation of coking heat. An embodiment in which the compacted blocks obtained are loaded into conventional ovens, however, is also conceivable.

The inventive process involves the advantage that compacted coal blocks can be cut from a compressed coal cake in an accurate, quick and very precise way. The use of a non-mechanical cutting tool excludes abrasion. The formation of coal dust in the inventive method is very low. The size of the compacted coal blocks produced is very exact and the dimensions of the cut-in channel depths are well defined. This allows improved degassing of the coking gases.

The invention claimed is:

1. A method for the production of compacted individual blocks suitable for coke-oven chambers by non-mechanical cutting of a compressed coal cake, in which the coal is compressed and compacted into one or a plurality of coal cake portions by means of a suitable compression device to obtain at least one densely packed and lump-free coal cake, wherein the coal cake obtained is cut into compacted blocks by non-mechanical, cutting-energy providing media to obtain compacted coal blocks from a compressed coal cake in precisely sized portion.

2. The method for the production of compacted individual blocks suitable for coke-oven chambers by non-mechanical cutting of a compressed coal cake according to claim 1, wherein the compacted coal blocks are loaded into a coke-oven chamber to be loaded horizontally either separately or horizontally strung together or stacked on top of each other or horizontally strung together and stacked on top of each other.

3. The method for the production of compacted individual blocks suitable for coke-oven chambers by non-mechanical cutting of a compressed coal cake according to claim 1, wherein the non-mechanical, cutting-energy providing medium is a laser beam.

4. The method for the production of compacted individual blocks suitable for coke-oven chambers by non-mechanical cutting of a compressed coal cake according to claim 1, wherein the non-mechanical, cutting-energy providing medium is a high-pressure water jet.

5. The method for the production of compacted individual blocks suitable for coke-oven chambers by non-mechanical cutting of a compressed coal cake according to claim 1, wherein the non-mechanical, cutting-energy providing medium is a solid abrasive blast.

6. The method for the production of compacted individual blocks suitable for coke-oven chambers by non-mechanical cutting of a compressed coal cake according to claim 1, wherein the non-mechanical, cutting-energy providing medium is a compressed-air jet.

7. The method for the production of compacted individual blocks suitable for coke-oven chambers by non-mechanical cutting of a compressed coal cake according to claim 1, wherein the non-mechanical, cutting-energy providing medium is a nitrogen gas jet.

8. The method for the production of compacted individual blocks suitable for coke-oven chambers by non-mechanical cutting of a compressed coal cake according to claim 1, wherein the non-mechanical, cutting-energy providing medium is ultrasound.

9. The method for the production of compacted individual blocks suitable for coke-oven chambers by non-mechanical cutting of a compressed coal cake according to claim 2, wherein cutting of the compacted coal blocks is performed by a combination of the specified non-mechanical cutting methods.

10. The method for the production of compacted individual blocks suitable for coke-oven chambers by non-mechanical cutting of a compressed coal cake according to claim 1, wherein horizontal or vertical gap-retaining spacers made of combustible material are placed between the compacted blocks produced to obtain a gap geometry upon spacer burn-up at high oven temperatures.

11. The method for the production of compacted individual blocks suitable for coke-oven chambers by non-mechanical cutting of a compressed coal cake according to claim 10, wherein the insertion of the spacers subsequent to the cutting of the coal cake by a non-mechanical, cutting-energy providing medium is implemented prior to or during the loading operation.

12. The method for the production of compacted individual blocks suitable for coke-oven chambers by non-mechanical cutting of a compressed coal cake according to claim 10, wherein the spacers have a thickness of up to 200 mm.

13. Method for the production of compacted individual blocks suitable for coke-oven chambers by non-mechanical cutting of a compressed coal cake according to claim 10, wherein the defined gaps thus generated have a width of at least 5 mm in the finished coke cake.

14. Method for the production of compacted individual blocks suitable for coke-oven chambers by non-mechanical cutting of a compressed coal cake according to claim 1, wherein the compacted coal blocks obtained are loaded into a horizontal Non-Recovery or Heat Recovery type.

* * * * *